US010137709B2

(12) United States Patent
Hamano

(10) Patent No.: US 10,137,709 B2
(45) Date of Patent: Nov. 27, 2018

(54) RECORDING DEVICE AND MEDIUM FEEDING METHOD FOR RECORDING DEVICE

(71) Applicant: SEIKO EPSON CORPORATION, Tokyo (JP)

(72) Inventor: Ryo Hamano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/459,241

(22) Filed: Mar. 15, 2017

(65) Prior Publication Data

US 2017/0266999 A1 Sep. 21, 2017

(30) Foreign Application Priority Data

Mar. 17, 2016 (JP) ..... 2016-053454

(51) Int. Cl.

| | |
|---|---|
| ***B41J 11/70*** | (2006.01) |
| ***B41J 13/00*** | (2006.01) |
| ***B41J 11/00*** | (2006.01) |
| ***B41J 11/42*** | (2006.01) |
| ***B41J 15/04*** | (2006.01) |

(52) U.S. Cl.

CPC ..... *B41J 11/70* (2013.01); *B41J 11/006* (2013.01); *B41J 11/0095* (2013.01); *B41J 11/42* (2013.01); *B41J 13/0036* (2013.01); *B41J 15/04* (2013.01)

(58) Field of Classification Search

CPC . B41J 11/70; B41J 11/66; B41J 11/663; B41J 11/666; B41J 11/68; B41J 15/04; B41J 11/0095; B41J 11/42; B41J 11/006

See application file for complete search history.

(56) References Cited

U.S. PATENT DOCUMENTS

2011/0242257 A1* 10/2011 Takami ..... B41J 11/006 347/218

FOREIGN PATENT DOCUMENTS

JP 2010-017870 1/2010

* cited by examiner

*Primary Examiner* — Julian D Huffman
(74) *Attorney, Agent, or Firm* — Workman Nydegger

(57) ABSTRACT

A recording device includes a feeding roller which feeds a medium; and a groove which is provided on a downstream side of the feeding roller in a feeding path of the medium and is used for cutting the medium. The feeding roller feeds the medium to an upstream side before feeding the medium to the downstream side, after the medium is cut at a position of the groove. It is preferable that the recording device further include a control portion which controls the feeding roller so that the feeding roller feeds the medium to the upstream side before feeding the medium to the downstream side, in a case where whether or not there is a possibility that the medium is cut at the position of the groove is determined and thus it is determined that there is a possibility that the medium is cut at the position of the groove.

5 Claims, 8 Drawing Sheets

RECORDING DEVICE AND MEDIUM FEEDING METHOD FOR RECORDING DEVICE

BACKGROUND

1. Technical Field

The present invention relates to a recording device for recording on a medium and a medium feeding method for a recording device.

2. Related Art

An ink jet printer as an example of a recording device will be described as an example. Among ink jet printers, there is known an ink jet printer which includes a platen for supporting a recording medium and a carriage on which a recording head and a cutting mechanism are mounted, and which cuts the recording medium by the carriage moving. A groove is formed at a position where a cutter of the cutting mechanism goes down in this platen (see JP-A-2010-017870).

There is a case where the leading end portion of the cut medium enters the groove after the medium is cut at the position of the groove, in the recording device. In a case where the medium is fed to a downstream side in this state, the leading end portion of the medium enters the groove, and thus jamming of the medium is caused.

SUMMARY

An advantage of some aspects of the invention is to provide a recording device which is capable of properly feeding a medium after the medium is cut at a groove position and a medium feeding method for a recording device.

According to an aspect of the invention, a recording device includes a feeding portion which feeds a medium and a groove which is provided on a downstream side of the feeding portion in a feeding path of the medium and is used for cutting the medium. The feeding portion feeds the medium to an upstream side before feeding the medium to the downstream side, after the medium is cut at a position of the groove.

According to the configuration, even if the leading end portion of the cut medium enters the groove after the medium is cut at the position of the groove, since the medium is fed to the upstream side before the medium is fed to the downstream side by the feeding portion, the leading end portion of the medium is pulled out from the groove. Accordingly, in a case where the medium is fed to the downstream side, the leading end portion of the medium is prevented from entering the groove. Therefore, after the medium is cut at the position of the groove, the medium can be properly fed.

According to another aspect of the invention, a medium feeding method for a recording medium performs determining whether or not there is a possibility that a medium is cut at a position of a groove which is provided on a downstream side of a feeding portion for feeding the medium in a feeding path of the medium and is used for cutting the medium; and feeding the medium to an upstream side before the feeding portion feeds the medium to the downstream side in a case where it is determined that there is a possibility that the medium is cut.

According to the configuration, even if the leading end portion of the cut medium enters the groove after the medium is cut at the position of the groove, since the medium is fed to the upstream side before the medium is fed to the downstream side by the feeding portion, the leading end portion of the medium is pulled out from the groove. Accordingly, in a case where the medium is fed to the downstream side, the leading end portion of the medium is prevented from entering the groove. Therefore, after the medium is cut at the groove position, the medium can be properly fed. In addition, in a case where it is determined that there is a possibility that the medium is cut at the position of the groove, the medium is fed to the upstream side before the medium is fed to the downstream side by the feeding portion. Therefore, the medium can be fed to the upstream side only in a case where there is a possibility that the medium is cut.

It is preferable that the recording device further include a control portion which controls the feeding portion so that the feeding portion feeds the medium to the upstream side before feeding the medium to the downstream side, in a case where whether or not there is a possibility that the medium is cut at the position of the groove is determined and thus it is determined that there is a possibility that the medium is cut at the position of the groove.

According to the configuration, in a case where it is determined that there is a possibility that the medium is cut at the position of the groove by the control portion, the medium is fed to the upstream side before the medium is fed to the downstream side by the feeding portion. Therefore, the medium can be fed to the upstream side only in a case where there is a possibility that the medium is cut.

In this case, it is preferable that the control portion control the feeding portion so that a trailing end of the recorded portion of the medium reaches a standby position which is different from the position in which the groove is provided in the feeding path at the end of a recording job, and the control portion determine whether or not there is a possibility that the medium is cut at the position of the groove and then determine whether or not the medium is fed by the feeding portion during the standby state between the recording jobs.

According to the configuration, in a case where it is determined that the medium is fed by the feeding portion during the standby state by the control portion, that is, in a case where there is a possibility that the medium is cut, the medium is fed to the upstream side before the medium is fed to the downstream side by the feeding portion. Therefore, the medium can be fed to the upstream side only in a case where there is a possibility that the medium is cut.

In this case, it is preferable that the recording device further include a feed detecting portion which detects feeding amount of the medium and the control portion determine whether or not the medium is fed by the feeding portion during the standby state based on the feeding amount detected by the feed detecting portion during the standby state.

According to the configuration, whether or not the medium is fed by the feeding portion during the standby state is determined by the control portion based on a detecting result of the feed detecting portion which detects the feeding amount.

In this case, it is preferable that the recording device further include an operating portion which receives an instruction of feeding the medium, and the control portion control the feeding portion so that the feeding portion feeds the medium when the operating portion receives the instruction of feeding the medium and the control portion determine whether or not the medium is fed by the feeding portion during the standby state based on whether or not the operating portion receives the instruction of feeding the medium during the standby state.

According to the configuration, by control portion, whether or not the medium is fed by the feeding portion during the standby state is determined based on whether or not the operating portion receives the instruction of feeding the medium during the standby state.

In this case, it is preferable that the recording device further include a medium detecting portion which detects presence or absence of the medium at a detecting position on the downstream side of the groove in the feeding path, and the control portion determine whether or not there is a possibility that the medium is cut at the position of the groove and then determine whether or not there is the medium on the downstream side of the groove based on a detecting result of the medium detecting portion.

According to the configuration, in a case where it is determined that there is no medium on the downstream side of the groove by the control portion, that is, in a case where there is a possibility that the medium is cut, the medium is fed to the upstream side before the medium is fed to the downstream side by the feeding portion. Therefore, the medium can be fed to the upstream side only in a case where there is a possibility that the medium is cut.

In this case, it is preferable that the recording device further include a cutting portion which cuts the medium at the position of the groove, and the control portion determine whether or not there is a possibility that the medium is cut at the position of the groove by whether or not the cutting portion is operated.

According to the configuration, in a case where it is determined that the cutting portion is operated by the control portion, that is, in the case where there is a possibility that the medium is cut, the medium is fed to the upstream side before the medium is fed to the downstream side by the feeding portion. Therefore, the medium can be fed to the upstream side only in a case where there is a possibility that the medium is cut.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, with reference to drawings attached, a recording device 1A according to a first embodiment of the invention will be described.

Figure 1:
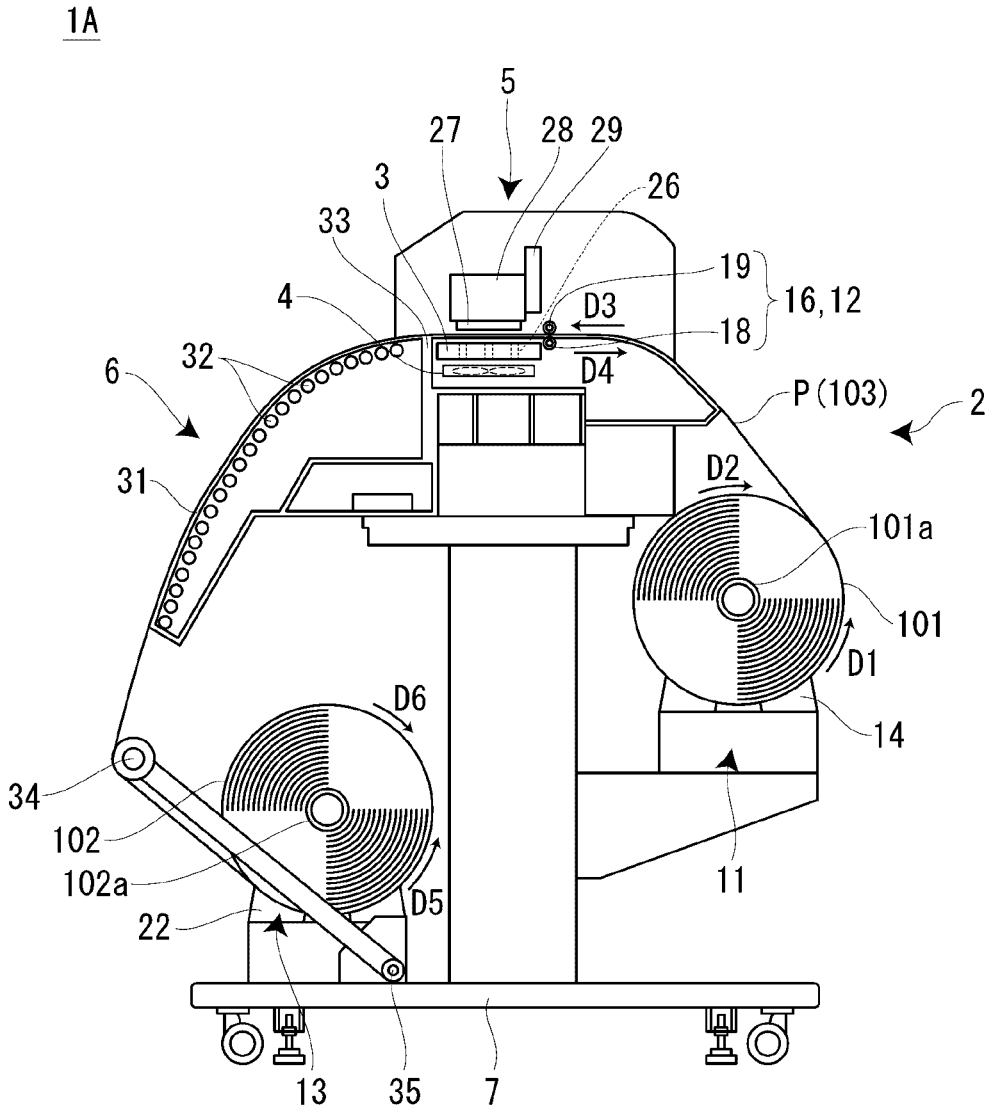
FIG. 1 is a view illustrating a schematic configuration of a recording device according to a first embodiment of the invention.

Based on FIG. 1, a schematic configuration of the recording device 1A will be described. The recording device 1A prints an image on a medium P by an ink jet method while feeding the medium P. The recording device 1A includes a medium feeding mechanism 2, a platen 3, a suction fan 4, a recording portion 5, a drying portion 6, and a supporting frame 7 which supports them.

The medium feeding mechanism 2 feeds the elongated medium P from an unwinding side roll object 101 to a winding side roll object 102 in a roll-to-roll manner. The unwinding side roll object 101 is one in which the medium P is wound around an unwinding side core 101*a* (for example, a paper tube). The winding side roll object 102 is one in which the medium P which is unwound from the unwinding side roll object 101 and on which the image is printed by the recording portion 5 is wound around the winding side core 102*a*. As the medium P, for example, various materials such as paper, film, cloth, or the like are used. The maximum width, the maximum diameter (diameter), and the maximum weight of the unwinding side roll object 101 which can be set in the recording device 1A are, for example, 64 inches (about 1.6 m), 250 mm, and 80 kg, respectively. The medium feeding mechanism 2 includes an unwinding portion 11, a transporting portion 12, and a winding portion 13.

The unwinding side roll object 101 is set on the unwinding portion 11. The unwinding portion 11 includes an unwinding side supporting portion 14 and an unwinding motor 15 (see FIG. 2). The unwinding side supporting portion 14 rotatably supports the unwinding side roll object 101. The unwinding motor 15 is a driving source for rotating the unwinding side roll object 101. The unwinding side roll object 101 rotates in an unwinding direction D1 so that the medium P is unwound from the unwinding side roll object 101 by the unwinding motor 15 rotating in one of the forward direction and the reverse direction. In addition, the unwinding side roll object 101 rotates in a rewinding direction D2 so that the medium P is rewound onto the unwinding side roll object 101 by the unwinding motor 15 rotating in the other one of the forward direction and the reverse direction.

The transporting portion 12 feeds the medium P which is unwound from the unwinding side roll object 101 toward the winding portion 13. The transporting portion 12 includes a feeding roller 16 and a feeding motor 17 (see FIG. 2). The feeding roller 16 includes a driving roller 18 and a driven roller 19. The driving roller 18 and the driven roller 19 feed the medium P which is sandwiched therebetween. The feeding motor 17 is a driving source for rotating the driving roller 18. The medium P is fed in a feeding direction D3, that is, in a downstream side of the feeding path 103, by the feeding motor 17 rotating in one of the forward direction and the reverse direction. In addition, the medium P is fed in a reverse feeding direction D4 which is a direction which is reverse to the feeding direction D3, which is in the upstream side of the feeding path 103 by the feeding motor 17 rotating in the other one of the forward direction and the reverse direction. The feeding roller 16 is an example of "feeding portion".

The winding portion 13 winds the fed medium P in a roll shape. The winding portion 13 includes a winding side supporting portion 22 and a winding motor 23 (see FIG. 2). The winding side supporting portion 22 rotatably supports the winding side core 102*a*. A leading end portion of the medium P is attached to the winding side core 102*a*. The winding motor 23 is a driving source for rotating the winding side core 102*a*. The winding side core 102*a* rotates in a winding direction D5 so that the medium P is wound around the winding side core 102*a* by the winding motor 23 rotating in one of the forward direction and a reverse direction. Accordingly, the winding side roll object 102 is formed. The winding side core 102*a* rotates in the repeatedly returning direction D6 which is reverse to the winding direction so that the medium P wound around the winding side core 102*a* is repeatedly returned by the winding motor 23 rotating in the other one of the forward direction and the reverse direction.

The platen 3 is provided on the downstream side of the feeding roller 16 on the feeding path 103. A plurality of suction holes 26 which are vertically penetrated are formed in the platen 3. The suction fan 4 is provided in a lower side of the platen 3. The medium P on the platen 3 is sucked and held by the suction fan 4 operating and thus an inside of the suction hole 26 being negative pressure. Ink is discharged from a recording head 27 to be described below on the medium P which is sucked and held on the platen 3.

The recording portion 5 records an image on the medium P. The recording portion 5 includes a recording head 27, a carriage 28, and a carriage moving mechanism 29. The recording head 27 discharges ink onto the medium P which is sucked onto an upper surface of the platen 3. The recording head 27 is mounted on the carriage 28. The carriage moving mechanism 29 reciprocates the carriage 28 in a direction intersecting with the feeding direction D3 of the medium P.

The drying portion 6 is provided on the downstream side of the recording portion 5 in the feeding path 103 of the medium P from the unwinding side roll object 101 to the winding side roll object 102. The drying portion 6 includes an aluminum plate 31 and a tube heater 32 which is provided on a rear surface of the aluminum plate 31. Drying of the medium P is promoted in a case where the medium P to which the ink is applied passes through the surface of the aluminum plate 31 by the tube heater 32 generating heat. A gap between the aluminum plate 31 and the platen 3 constitutes a groove 33. The groove 33 will be described below.

The supporting frame 7 includes a tension bar 34. The tension bar 34 is swingably supported by a bar support shaft 35. The tension bar 34 contacts the medium P which passes through the drying portion 6 and thus applies tension to the medium P. Accordingly, the medium P is wound up by the winding portion 13 in a state where a moderate tension is applied to the medium P.

Figure 2:
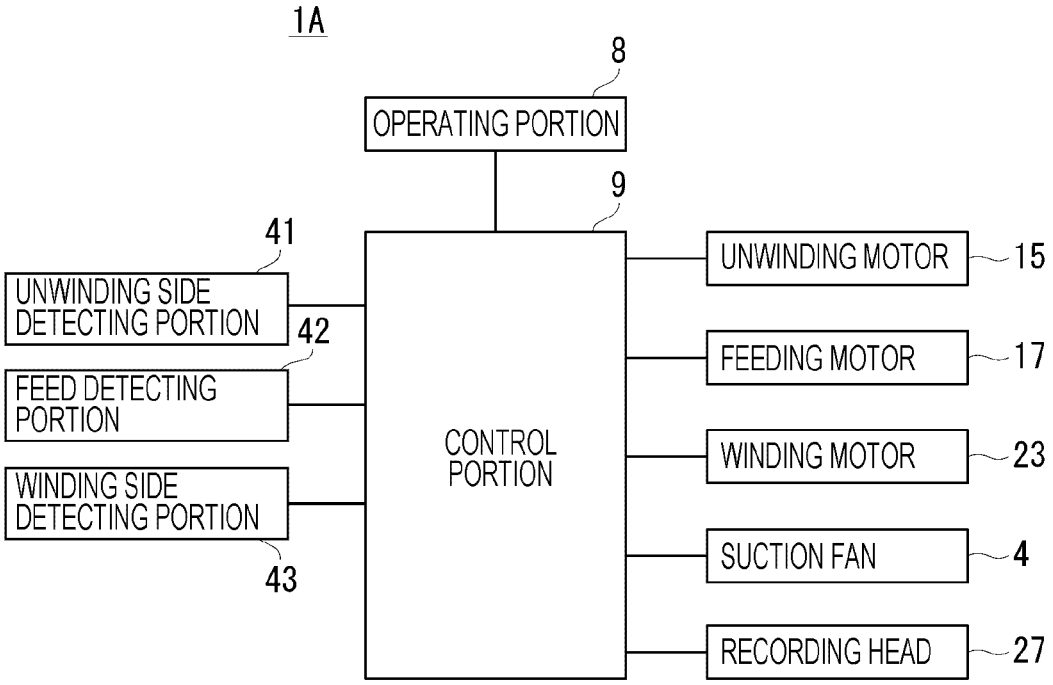
FIG. 2 is a block diagram of the recording device.

Based on FIG. 2, the schematic configuration of the recording device 1A will be further described. The recording device 1A includes an operating portion 8, a control portion 9, an unwinding side detecting portion 41, a feed detecting portion 42, and a winding side detecting portion 43.

The operating portion 8 receives various instructions such as an instruction of feeding the medium P from a user, and also displays menus, messages, or the like. As the operating portion 8, for example, an operation panel including a display, operation buttons, or the like can be used.

The control portion 9 totally controls each portion of the recording device 1A. Although not illustrated, the control portion 9 includes a central processing unit (CPU), a read only memory (ROM), a random access memory (RAM), a programmable ROM (PROM), an application specific integrated circuit (ASIC), a motor driver and a bus.

In addition, a host device (for example, a personal computer) (not illustrated) is communicably connected to the control portion 9. Upon receiving the recording job from the host device, the control portion 9 controls each portion of the recording device 1A based on the received recording job. Accordingly, the recording device 1A alternately repeats a dot forming operation and a feeding operation. Here, the dot forming operation is an operation of discharging ink from the recording head 27 and forming dots on the medium P while the carriage 28 is moved in a direction intersecting with the feeding direction D3 and is also referred to as main scanning. The feeding operation is an operation of feeding the medium P to the downstream side of the feeding path 103 and is also referred to as a sub scanning.

In addition, in a case where the operating portion 8 receives an instruction of feeding the medium P, the control portion 9 controls the feeding roller 16 via the feeding motor 17 so that the feeding roller 16 feeds the medium P.

The unwinding side detecting portion 41 detects rotating amount of the unwinding side roll object 101. For example, a rotary encoder which is provided in the unwinding motor 15 can be used as the unwinding side detecting portion 41.

The feed detecting portion 42 detects feeding amount of the medium P by the feeding roller 16. For example, a rotary encoder provided in the feeding motor 17 can be used as the feed detecting portion 42.

The winding side detecting portion 43 detects rotating amount of the winding side roll object 102. For example, a rotary encoder provided in the winding motor 23 can be used as the winding side detecting portion 43.

In a case where the medium P is fed, the feeding motor 17 is controlled based on a detecting result of the feed detecting portion 42. In addition, the roll diameter of the unwinding side roll object 101 is estimated based on the detecting result of the unwinding side detecting portion 41 and the detecting result of the feed detecting portion 42. The unwinding motor 15 is controlled based on the estimated roll diameter of the unwinding side roll object 101. Similarly, the roll diameter of the winding side roll object 102 is estimated based on the detecting result of the winding side detecting portion 43 and the detecting result of the feed detecting portion 42. The winding motor 23 is controlled based on the estimated roll diameter of the winding side roll object 102.

Figure 3:
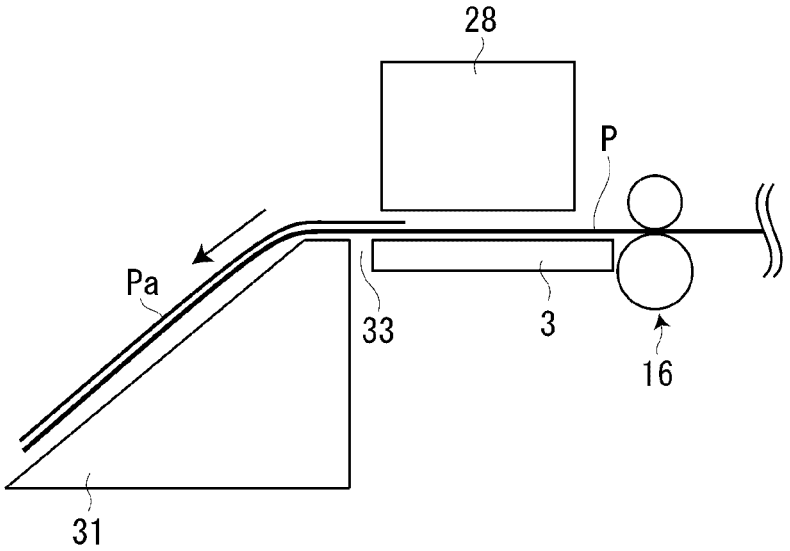
FIG. 3 is a view explaining a medium feeding method for a recording device at the time of cutting the medium.

A method for feeding the medium P by the recording device 1A at the time of cutting the medium P will be described based on FIG. 3 to FIG. 7. FIG. 3 illustrates a state in which the recording device 1A uses up to the nozzles on the downstream side of the recording head 27 and recording on the medium P is ended.

Figure 4:
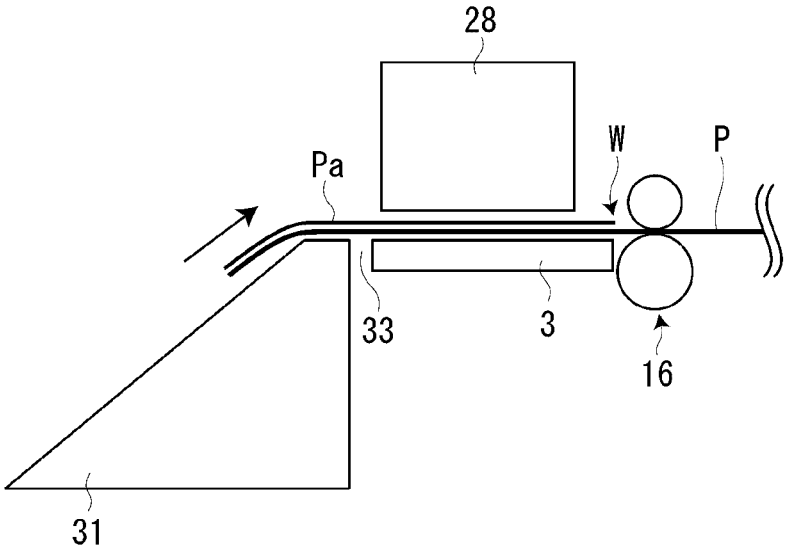
FIG. 4 is a view explaining the medium feeding method for a recording device at the time of cutting the medium, following FIG. 3.

Subsequently, as illustrated in FIG. 4, the recording device 1A feeds the medium P to the upstream side of the feeding path 103 by a predetermined amount and then becomes a standby state for the next recording job so that a trailing end of the recorded portion Pa which is a portion on which the ink has been discharged reaches the waiting position W near the downstream side of the feeding roller 16.

As described above, the medium P on which the image is recorded by the recording portion 5 is wound around the winding side core 102*a* by the winding portion 13. However, in the case where the user wants to wind up the medium P around another winding side roll object 102 during the medium P winding up around one unwinding side roll object 101 or in a case where the user wants to obtain a single cut sheet without winding up the medium P, or the like, during the standby state, the medium P is cut using the cutter C (see FIG. 5) or the like. According to this, in the recording device 1A, the groove 33 which is used for cutting the medium P is provided. Although the groove 33 may be provided on the downstream side of the feeding roller 16 in the feeding path 103, the gap between the aluminum plate 31 and the platen 3 constitutes the groove 33 in the embodiment, as described above. The groove 33 linearly extends in a direction intersecting with the feeding direction D3. In addition, the width of the groove 33, that is, the gap between the aluminum plate 31 and the platen 3 is about 2 to 3 mm, for example. The user can cut the medium P by moving the cutter C along the groove 33 while disposing the cutter C on a side wall of one side of the groove 33 in a state where the tip of the cutter C is inserted in an inside portion of the groove 33.

Figure 5:
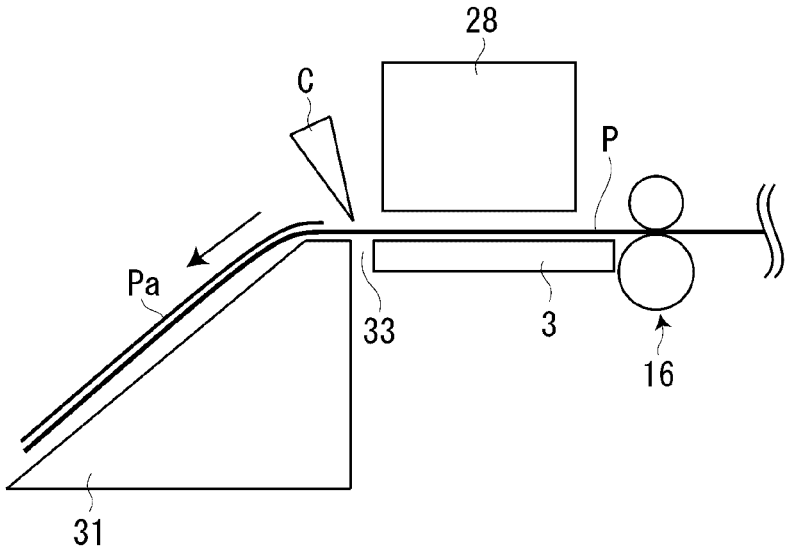
FIG. 5 is a view explaining a medium feeding method for a recording device at the time of cutting the medium, following FIG. 4.

In a case where the user intends to cut the medium P at the trailing end of the recorded portion Pa, as illustrated in FIG. 5, the user operates the operation button of the operating portion 8 and thus feeds the medium p until the trailing end of the recorded portion Pa reaches the position of the groove 33 or the downstream side of the position of the groove 33.

Figure 8:
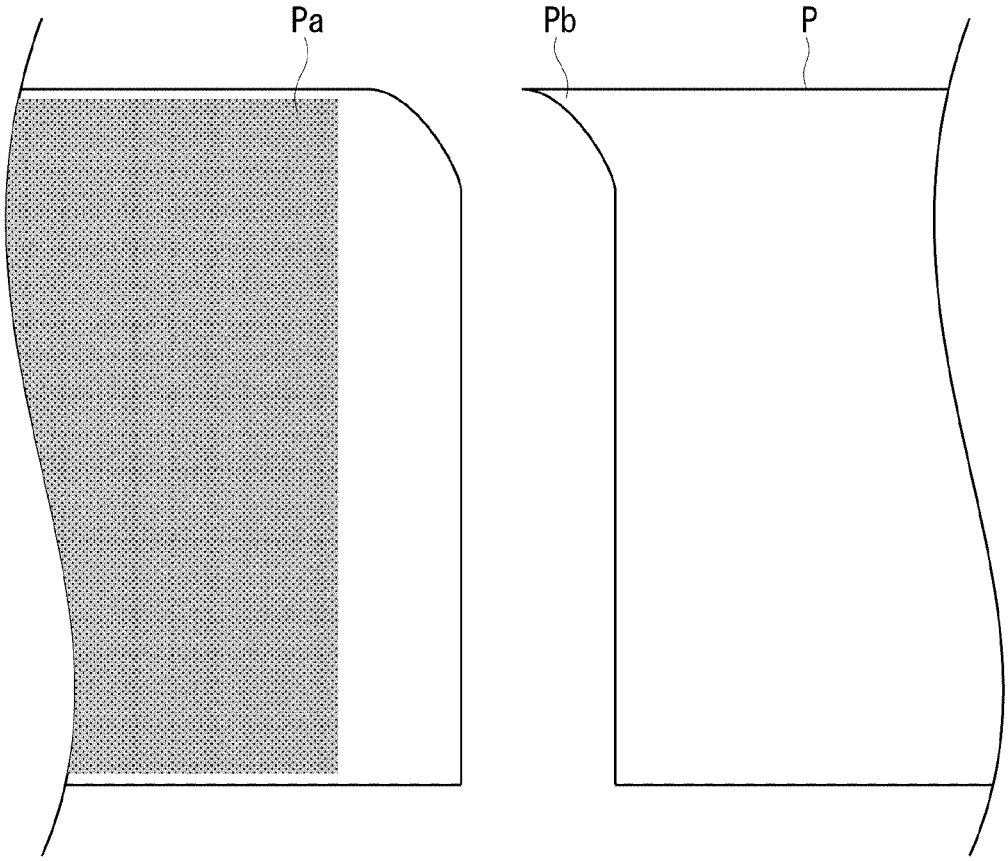
FIG. 8 is a view illustrating a state where a projecting portion is formed at the leading end portion of the cut medium as a result of the medium being cut into a curved shape.

The user cuts the medium P with the cutter C using the groove 33. However, as illustrated in FIG. 8, there is a case where a portion of the medium P is cut in a curved shape due to reasons such as the user not properly pressing the medium P at the time of cutting or the like. Among the leading end portion of the cut medium P, a portion which is cut in the curved shape and thus protrudes forward as compared with a portion which is cut in the linear shape is referred to as a projecting portion Pb. Since the projecting portion Pb is pushed into the inside of the groove 33 by the cutter at the time of formation thereof, the projecting portion Pb easily enters the inside of the groove 33.

Figure 6:
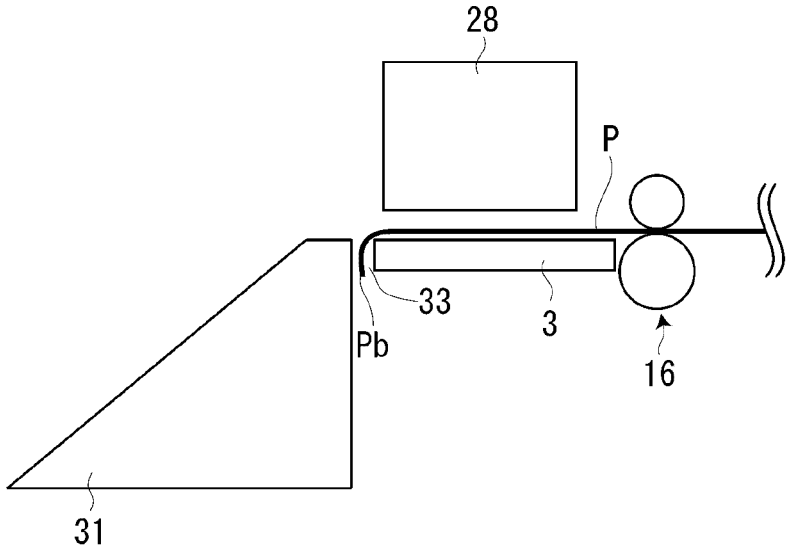
FIG. 6 is a view explaining the medium feeding method for a recording device at the time of cutting the medium, following FIG. 5.
Figure 7:
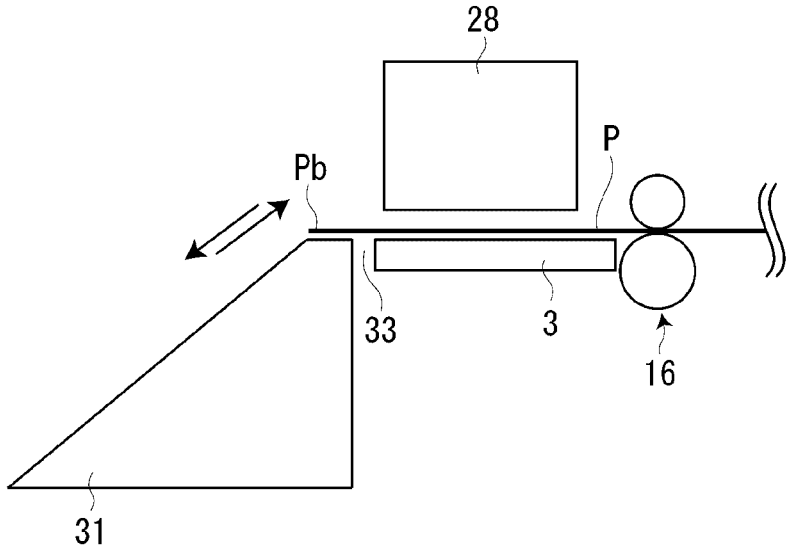
FIG. 7 is a view explaining the medium feeding method for a recording device at the time of cutting the medium, following FIG. 6.

FIG. 6 illustrates a state in which the projecting portion Pb formed at the leading end of the cut medium P enters the inside of the groove 33. In this state, when the recording device 1A receives the next recording job, a feeding operation is performed based on the recording job and thus the medium P is fed to the downstream side, the medium P enters the groove 33, jamming of the medium P is caused. Therefore, in a feeding control process to be described below, in a case where it is determined that there is a possibility that the medium P is cut at the position of the groove 33, the control portion 9 controls the feeding roller 16 so that the medium P is fed to the downstream side after the feeding roller 16 feeds the medium P to the upstream side, as illustrated in FIG. 7. Accordingly, since the projecting portion Pb is pulled out from the groove 33, thereafter, in a case where the medium P is fed to the downstream side, the medium P is prevented from entering the groove 33.

The groove 33 may be formed in a concave shape in which a bottom portion thereof capable of hitting the cutter C is provided in the middle of the gap. Even in this case, although the leading end portion of the medium P is pushed into the groove 33 at the time of cutting, the leading end portion of the medium P is caught in the groove 33 and is not fed to the downstream side is suppressed by the feeding control process to be described below.

Figure 9:
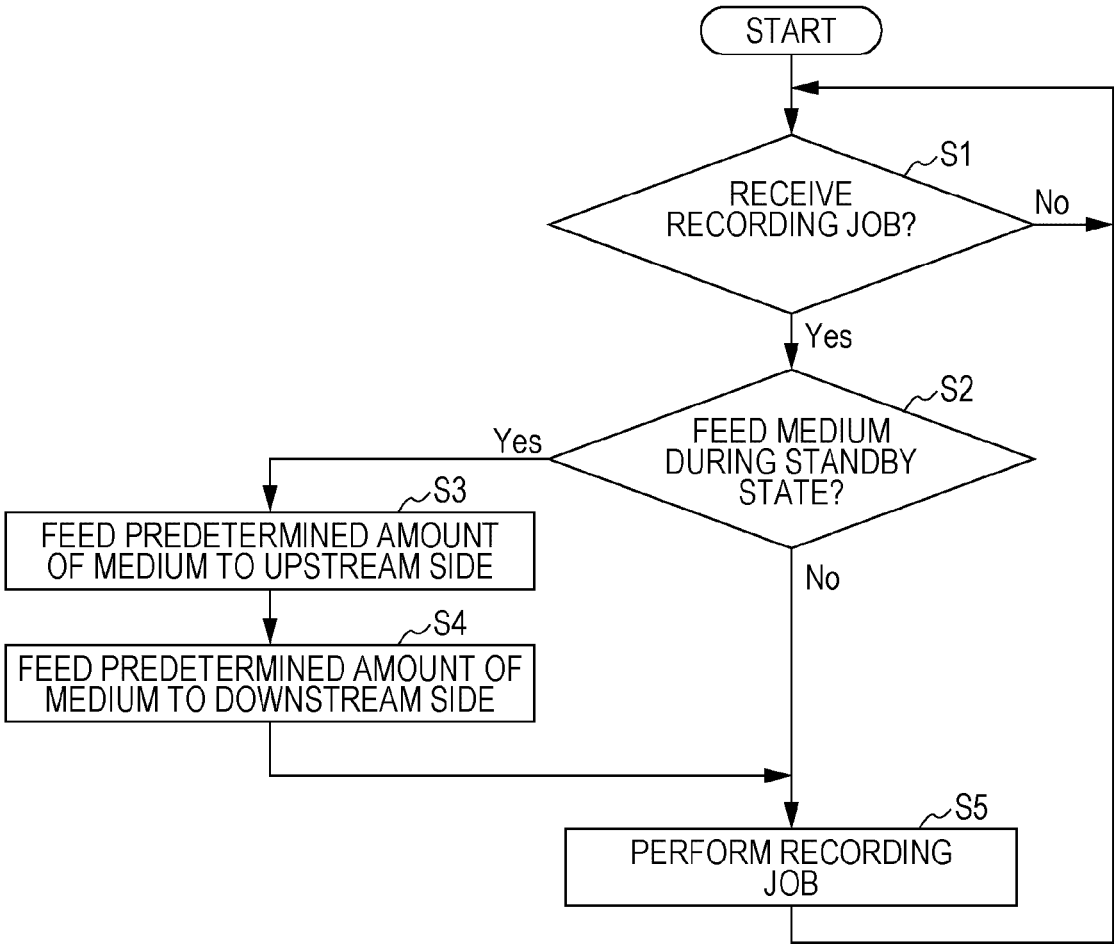
FIG. 9 is a flowchart illustrating a flow of a feeding control process.

The flow of the feeding control process will be described based on FIG. 9. The control portion 9 determines whether or not a recording job is received, in step S1 which is during the standby state between recording jobs. In a case where it is determined that the recording job has been received (S1; Yes), the control portion 9 proceeds to step S2.

Here, as described above, in a case where the medium P is fed during the standby state, since the medium P is fed such that the trailing end of the recorded portion Pa reaches the downstream side of the groove 33 from the standby position W in a case where the medium P is cut at the position of the groove 33, there is a possibility that the medium P is cut at the position of the groove 33.

Therefore, in step S2, the control portion 9 determines whether or not there is a possibility that the medium P is cut at the position of the groove 33, and then the control portion 9 determines whether or not the medium P is fed to the downstream side by the feeding roller 16 during the standby state, based on the feeding amount of the medium which is detected by the feed detecting portion 42 during the standby. In other words, in a case where the feeding amount of the medium P to the downstream side which is detected by the feed detecting portion 42 during the standby state is equal to or greater than the predetermined amount, the control portion 9 determines that the medium P is fed to the downstream side by the feeding roller 16 during the standby states (S2; Yes), and the process proceeds to step S3. On the other hand, in a case where the feeding amount of the medium P to the downstream side which is detected by the feed detecting portion 42 during the standby state is less than the predetermined amount, the control portion 9 determines that the feeding roller 16 does not feed the medium P to the downstream side (S2; No), and the process proceeds to step S5.

In step S3, the control portion 9 controls the feeding roller 16 via the feeding motor 17 so that the feeding roller 16 feeds the medium P to the upstream side by a predetermined amount. Even if the projecting portion Pb enters the inside of the groove 33 after the medium P is cut by the medium P being fed to the upstream side, the projecting portion Pb can be pulled out from the groove 33. The predetermined amount by which the medium P is fed in the reverse feeding direction D4 is not particularly limited as long as the predetermined amount is amount which allows the projecting portion Pb to be pulled out from the groove 33 and the predetermined amount is 10 mm, for example. In addition, in a case where the groove 33 has a bottom portion and is formed in a concave shape, the medium P may be fed by an amount which is equal to or greater than the distance from the edge of the groove 33 to the bottom portion in the reverse feeding direction D4.

In step S4, the control portion 9 controls the feeding roller 16 via the feeding motor 17 so that the medium P is fed to the downstream side by the same amount as being fed to the upstream side in step S3 by the feeding roller 16. Accordingly, the medium P returns to the position before being fed to the upstream side. At this time, since the projecting portion Pb is pulled out from the groove 33, even if the medium P is fed to the downstream side, the medium P is prevented from entering the groove 33. The feeding amount to the downstream side need not be the same as the feeding amount to the upstream side in step S4. In addition, the feeding itself to the downstream side may be omitted in step S4.

In step S5, the control portion 9 executes the recording job. The control portion 9 controls the feeding roller 16 via the feeding motor 17 so that the feed operation is performed based on the recording job, that is, the feeding roller 16 feeds the medium P to the downstream side. At this time, as described above, since the protruding portion Pb is pulled from the groove 33 by the medium P being fed to the upstream side in step S3 even if the protruding portion Pb enters the groove 33 after cutting the medium P being cut, the medium P is prevented from entering the groove 33 even if the medium P is fed to the downstream side in the feeding operation. When the control portion 9 ends the recording job, the control portion 9 returns to step S1 which is the standby state.

Accordingly, in a case where control portion 9 determines that the medium P is fed to the downstream side by the feeding roller 16 during the standby state, the control portion 9 controls the feeding roller 16 so that the feeding roller 16 feeds the medium P to the upstream side before feeding the medium P to the downstream side. On the other hand, in a case where the control portion 9 determines that the feeding roller 16 does not feed the medium P to the downstream side during the standby state, the control portion 9 controls the feeding roller 16 so that the feeding roller 16 feeds the medium P to the downstream side without feeding the medium P to the upstream side.

As described above, the recording device 1A of the embodiment includes the feeding roller 16 and the groove 33. The feeding roller 16 feeds the medium P. The groove 33 is provided on the downstream side of the feeding roller 16 in the feeding path 103 of the medium P and is used for cutting the medium P. After the medium P is cut at the position of the groove 33, the feeding roller 16 feeds the medium P to the upstream side before feeding the medium P to the downstream side.

According to the configuration, even if the leading end portion of the cut medium P, for example, the projecting portion Pb formed at the leading end portion enters the inside of the groove 33 after the medium P is cut at the position of the groove 33, since the medium P is fed to the upstream side before medium P is to the downstream side fed by the feeding roller 16, the leading end portion of the medium P is pulled out from the groove 33. Accordingly, in a case where the medium P is fed to the downstream side, the medium P is prevented from entering the groove 33. Therefore, after the medium P is cut at the position of the groove 33, the medium P can be properly fed.

In addition, the medium feeding method for a recording device 1A of the embodiment performs the following steps.

A step for determining whether or not there is a possibility that the medium P is cut at the position of the groove 33 which is provided on the downstream side of the feeding roller 16 which feeds the medium P in the feeding path 103 of the medium P and is used in cutting of the medium P.

A step for feeding the medium P to the upstream side before the feeding roller 16 feeds the medium P to the downstream side in a case where it is determined that there is a possibility that the medium P is cut.

According to the configuration, even if the leading end portion of the cut medium P, for example, the projecting portion Pb formed at the leading end portion enters the inside of the groove 33 after the medium P is cut at the position of the groove 33, since the medium P is fed to the upstream side before being sent to the downstream side by the feeding roller 16, the leading end portion of the medium P is pulled out from the groove 33. Accordingly, in a case where the medium P is fed to the downstream side, the medium P is prevented from entering the groove 33. Therefore, after the medium P is cut at the position of the groove 33, the medium P can be properly fed. In addition, in a case where it is determined that there is a possibility that the medium P is cut at the position of the groove 33, the medium P is fed to the upstream side before being fed to the downstream side by the feeding roller 16. Therefore, the medium P can be fed to the upstream side only in a case where there is a possibility that the medium P is cut.

In addition, the recording device 1A of the embodiment further includes the control portion 9 which determines whether or not there is a possibility that the medium P is cut at the position of the groove 33. In a case where the control portion 9 determines there is a possibility that the medium P is cut at the position of the groove 33, the control portion 9 controls the feeding roller 16 so that the feeding roller 16 feeds the medium P to the upstream side before feeding the medium P to the downstream side.

According to the configuration, in a case where it is determined that there is a possibility that the medium P is cut at the position of the groove 33 by the control portion 9, the medium P is fed to the upstream side before the medium P is fed to the downstream side by the feeding roller 16. Therefore, the medium P can be fed to the upstream side only in a case where there is a possibility that the medium P is cut.

In addition, in the recording device 1A of the embodiment, when the recording job is ended, the control portion 9 controls the feeding roller 16 so that the trailing end of the recorded portion Pa of the medium P reaches the standby position W which is different from the position in which the groove 33 is provided in the feeding path 103. The control portion 9 determines whether or not there is a possibility that the medium P is cut at the position of the groove 33, and then the control portion 9 determines whether or not the medium P is fed by the feeding roller 16 during the standby state between the recording jobs.

According to the configuration, in a case where the control portion 9 determines that the medium P is fed by the feeding roller 16 during the standby state, that is, in a case where there is a possibility that the medium P is cut, the feeding roller 16 feeds the medium P to the upstream side before feeding the medium P to the downstream side. Therefore, the medium P can be fed to the upstream side only in a case where there is a possibility that the medium P is cut.

In addition, the recording device 1A of the embodiment further includes the feed detecting portion 42 which detects the feeding amount of the medium P. The control portion 9 determines whether or not the medium P is fed by the feeding roller 16 during the standby state based on the feeding amount which is detected by the feed detecting portion 42 during the standby state.

According to the configuration, whether or not the medium P is fed by the feeding roller 16 is determined by the control portion 9 during the standby state based on the detecting result of the feed detecting portion 42 which detects the feeding amount.

The control portion 9 may determine whether or not the medium P is fed by the feeding roller 16 during the standby state based on whether or not the operating portion 8 receives the instruction of feeding the medium P during the standby state. In this case, in a case where the operating portion 8 receives an instruction of feeding the medium P during the standby state, the control portion 9 determines that the medium P is fed by the feeding roller 16 during the standby state. On the other hand, in a case where the operating portion 8 does not receive the instruction of feeding the medium P during the standby state, the control portion 9 determines that the feeding roller 16 does not feed the medium P during the standby state.

According to the configuration, whether or not the medium P is fed by the feeding roller 16 during the standby state is determined by the control portion 9 based on whether or not the operating portion 8 receives the instruction of feeding the medium P during the standby state.

Figure 10:
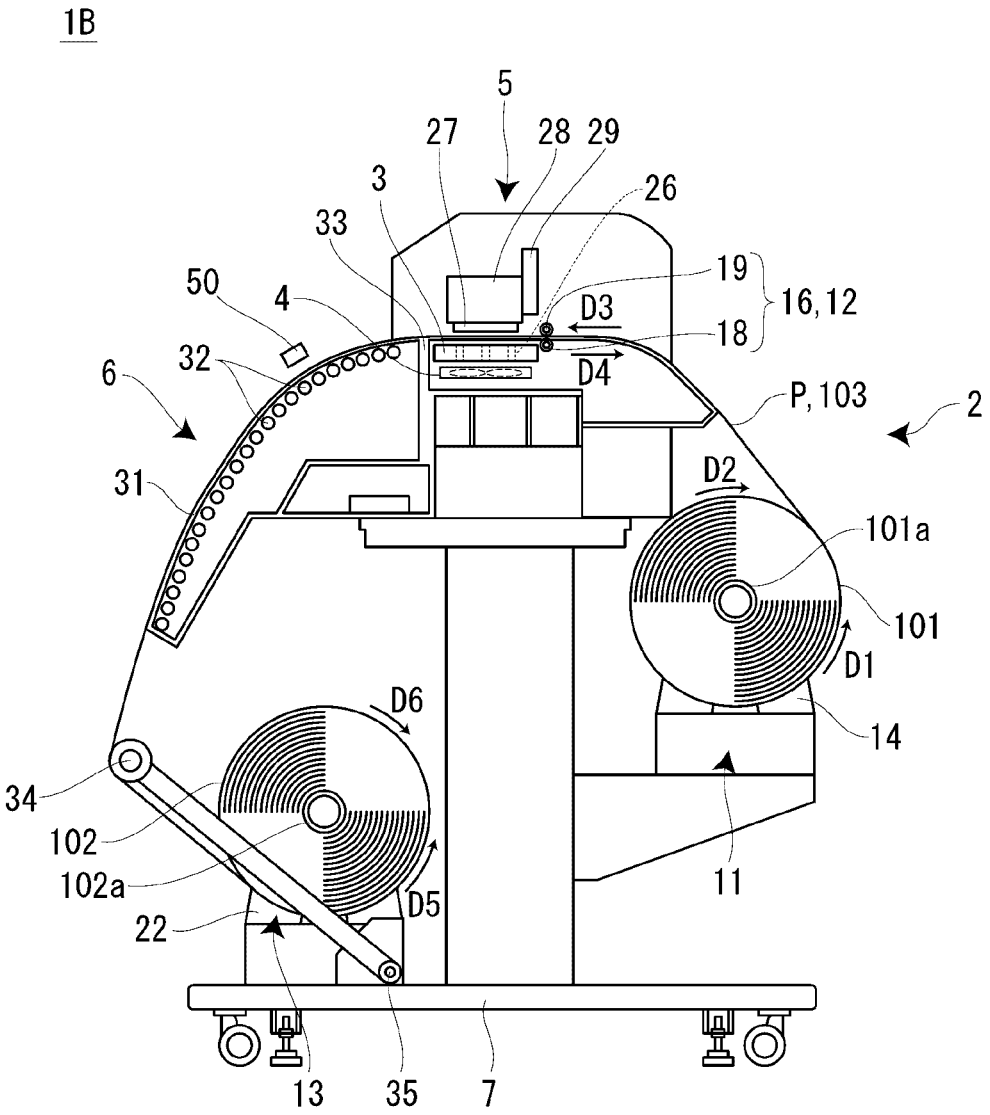
FIG. 10 is a view illustrating a schematic configuration of a recording device according to a second embodiment of the invention.

Based on FIG. 10, a recording device 1B according to a second embodiment of the invention will be described. The recording device 1B has substantially the same configuration as the recording device 1A of the first embodiment and further includes a medium detecting portion 50. The medium detecting portion 50 detects presence or absence of the medium P at the detecting position which is on the downstream side of the groove 33 in the feeding path 103.

Since the medium P on the downstream side of the groove 33 is removed from the feeding path 103 in a case where the medium P is cut at the position of the groove 33, there is a possibility that medium P is cut in a case where there is no medium P on the downstream side of the groove 33. Therefore, in a case where the control portion 9 determines whether or not there is a possibility that the medium P is cut, the control portion 9 determines whether or not there is the medium P on the downstream side of the groove 33 based on the detecting result of the medium detecting portion 50. In a case where the control portion 9 determines that there is no medium P on the downstream side of the groove 33, the control portion 9 controls the feeding roller 16 so that the feeding roller 16 feeds the medium P to the upstream side before feeding the medium P to the downstream side. As the medium detecting portion 50, for example, a reflection type photosensor can be used.

Accordingly, in the recording device 1B, in a case where it is determined that there is no medium P on the downstream side of the groove 33 by the control portion 9, that is, in the case where there is a possibility that the medium P is cut, the medium P is fed to the upstream side before feeding to the downstream side by the feeding roller 16. Therefore, the medium P can be fed to the upstream side only in a case where there is a possibility that the medium P is cut.

Figure 11:
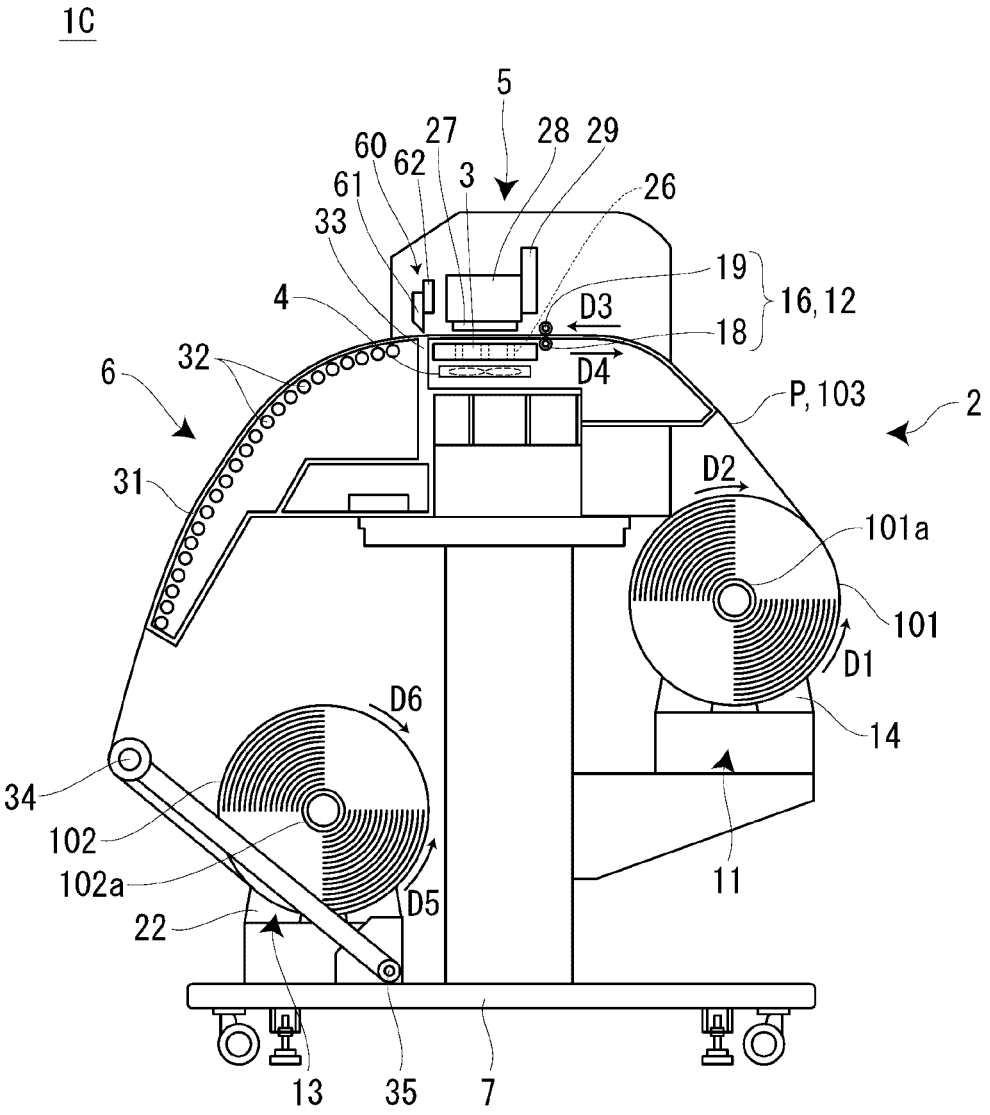
FIG. 11 is a view illustrating a schematic configuration of a recording device according to a third embodiment of the invention.

Based on FIG. 11, a recording device 1C according to a third embodiment of the invention will be described. The recording device 1C has substantially the same configuration as the recording device 1A of the first embodiment, and further includes a cutting portion 60 which cuts the medium P at the position of the groove 33. The cutting portion 60 includes a cutting blade 61 and a cutting blade moving mechanism 62 which moves the cutting blade 61 along the groove 33.

In a case where the cutting portion 60 is operated, there is a possibility that the medium P is cut. Therefore, the control portion 9 determines whether or not there is a possibility that the medium P is cut, and then the control portion 9 determines whether or not the cutting portion 60 is operated. In a case where the control portion 9 determines that the cutting portion 60 is operated, the control portion 9 controls the feeding roller 16 so that the feeding roller 16 feeds the medium P to the upstream side before feeding the medium P to the downstream side.

Accordingly, in the recording device 1C, in a case where the control portion 9 determines that the cutting portion 60 is operated, that is, in the case where there is a possibility that the medium P is cut, the feeding roller 16 feeds the medium P to the upstream side before feeding the medium P to the downstream side. Therefore, the medium P can be fed to the upstream side only in a case where there is a possibility that the medium P is cut.

Even in the recording device 1B and the recording device 1C, the control portion 9 determines whether or not there is a possibility that the medium P is cut, and then the control portion 9 determines whether or not the medium P is fed by the feeding roller 16 during the standby state, similarly to the recording device 1A.

The invention is not limited to the embodiments described above, and it goes without saying that various configurations can be adopted without departing from the gist of the invention. For example, the embodiment can be changed to the following form.

In a case where the medium P is always cut during the standby state, the control portion 9 controls the feeding roller 16 so that the feeding roller 16 always feeds the medium P to the upstream side before the next recording job is performed. Similarly, in a case where the cutting portion 60 always operates during the recording job in the recording device 1C in which the cutting portion 60 is provided, the control portion 9 may control the feeding roller 16 so that the feeding roller 16 always feeds the medium P to the upstream side after the cutting portion 60 is operated or before the next recording job is performed. In these cases, the control portion 9 does not need to determine whether or not there is a possibility that the medium P is cut at the position of the groove 33.

The position of the groove 33 may be provided on the downstream side of the feeding roller 16 in the feeding path 103. For example, the groove 33 may be configured by a gap between members other than the platen 3 and the aluminum plate 31, and is formed by the platen 3 or the like.

The standby position W is not limited to the vicinity of the downstream side of the feeding roller 16, may be another position on the upstream side of the groove 33 and further may be a position on the downstream side of the groove 33. In a case where the standby position W is on the downstream side of the groove 33, when the medium P is cut at the position of the groove 33, the medium P is fed to the upstream side so that the trailing end of the recorded portion Pa further approaches the groove 33 than the standby position W.

Application examples of the recording device of the invention are not limited to an ink jet recording device, and may be, for example, a dot impact type recording device or an electrophotographic recording device.

This application claims priority under 35 U.S.C. § 119 to Japanese Patent Application No. 2016-053454, filed Mar. 17, 2016. The entire disclosure of Japanese Patent Application No. 2016-053454 is hereby incorporated herein by reference.

What is claimed is:

1. A recording device comprising:

a feeding portion which feeds a medium;

a medium support comprising a first support portion and a second support portion, the feeding portion being upstream of the first and second support portions, a control portion which controls the feeding portion;

a groove which is provided on a downstream side of the first support portion and the upstream side of the second support portion in a feeding path of the medium; and a cutter that is used for cutting the medium at the position of the groove, wherein the control portion controls the feeding portion so that the feeding portion feeds a leading edge of the cut medium to an upstream side before feeding the leading edge of the medium to the downstream side of the groove, after the medium is cut at a position of the groove;

wherein the control portion controls the feeding portion so that a trailing end of the recorded portion of the medium reaches a standby position which is different from the position in which the groove is provided in the feeding path at the end of a recording job, and wherein the control portion determines whether or not the medium is to be cut at the position of the groove and then determines whether or not the medium is fed by the feeding portion during the standby state between the recording jobs.

2. The recording device according to claim 1, further comprising:

a feed detecting portion which detects feeding amount of the medium, wherein the control portion determines whether or not the medium is fed by the feeding portion during the standby state based on the feeding amount detected by the feed detecting portion during the standby state.

3. The recording device according to claim 1, further comprising: an operating portion which receives an instruction of feeding the medium, wherein the control portion controls the feeding portion so that the feeding portion feeds the medium when the operating portion receives the instruction of feeding the medium and the control portion determines whether or not the medium is fed by the feeding portion during the standby state based on whether or not the operating portion receives the instruction of feeding the medium during the standby state.

4. The recording device according to claim 1, wherein the control portion determines whether or not there is a possibility that the medium is cut at the position of the groove by whether or not the cutting portion is operated.

5. A recording device comprising:

a feeding portion which feeds a medium;

a medium support comprising a first support portion and a second support portion, the feeding portion being upstream of the first and second support portions, a control portion which controls the feeding portion;

a groove which is provided on a downstream side of the first support portion and the upstream side of the second support portion in a feeding path of the medium; and a cutter that is used for cutting the medium at the position of the groove;

a medium detecting portion which detects presence or absence of the leading edge of the medium at a detecting position on the downstream side of the groove in the feeding path wherein the control portion:

controls the feeding portion so that the feeding portion feeds a leading edge of the cut medium to an upstream side before feeding the leading edge of the medium to the downstream side of the groove, after the medium is cut at a position of the groove; and determines whether or not the medium is to be cut at the position of the groove and then determines whether or not there is the leading edge of the medium on the downstream side of the groove based on a detecting result of the medium detecting portion.

* * * * *